US005137208A

United States Patent [19]

Wang et al.

[11] Patent Number: 5,137,208

[45] Date of Patent: * Aug. 11, 1992

[54] TAMPER EVIDENT PACKAGE

[75] Inventors: Alan Wang, Hiffman Estates; William F. K. Wang, Schaumburg, both of Ill.

[73] Assignee: TSL Incorporated, Aurora, Colo.

[ * ] Notice: The portion of the term of this patent subsequent to Jan. 2, 2007 has been disclaimed.

[21] Appl. No.: 545,530

[22] Filed: Jun. 29, 1990

[51] Int. Cl.[5] ..... B65D 3/06; B65D 53/06

[52] U.S. Cl. ..... 229/102; 206/807; 229/208; 428/34.2; 428/913; 428/916

[58] Field of Search ..... 229/102, 208, 245; 206/807, 524.3, 524.8; 428/34.1, 34.2, 913, 916

[56] References Cited

U.S. PATENT DOCUMENTS

| | | | |
|---|---|---|---|
| 1,664,635 | 4/1928 | Magill . | |
| 2,074,490 | 3/1937 | Schwartz . | |
| 2,127,548 | 8/1938 | Boyle et al. . | |
| 3,415,402 | 12/1968 | Webber . | |
| 3,662,915 | 5/1972 | Destler, Jr. . | |
| 3,700,643 | 10/1972 | Smith et al. | 260/77.5 A N |
| 3,783,089 | 1/1974 | Hurst et al. . | |
| 3,786,777 | 1/1974 | Smith et al. . | |
| 3,935,960 | 2/1976 | Cornell . | |
| 4,098,577 | 7/1978 | Halpern . | |
| 4,181,223 | 1/1980 | Millet . | |
| 4,271,223 | 6/1981 | Lambert et al. | 260/31.2 N |
| 4,424,252 | 1/1984 | Nativi . | |
| 4,436,203 | 3/1984 | Reyner . | |
| 4,449,632 | 5/1984 | Marusiak, Jr. . | |
| 4,451,523 | 5/1984 | Nativi et al. . | |
| 4,479,585 | 10/1984 | Sandhaus . | |
| 4,502,605 | 3/1985 | Wloszcyna . | |
| 4,505,399 | 3/1985 | Weiner . | |
| 4,511,052 | 4/1985 | Klein et al. | 206/807 |
| 4,516,679 | 5/1985 | Simpson et al. . | |
| 4,546,881 | 10/1985 | Tasma . | |
| 4,652,473 | 3/1987 | Han | 229/102 |
| 4,718,553 | 1/1988 | Adamoli et al. . | |
| 4,759,445 | 7/1988 | McVay et al. . | |
| 4,876,123 | 10/1989 | Rivera et al. | 229/102 |
| 4,890,763 | 1/1990 | Curiel . | |
| 4,931,327 | 6/1990 | Liu et al. | 428/34.1 |
| 4,945,708 | 8/1990 | Curiel | 206/807 |
| 4,980,222 | 12/1990 | Rivera et al. | 428/34.2 |

*Primary Examiner*—Gary E. Elkins

*Attorney, Agent, or Firm*—Arnold B. Silverman; David V. Radack

[57] ABSTRACT

The invention provides a package for packaging of products which provides evidence of tampering with or adulteration of the product by providing a readily visible indication that any such tampering or adulteration has occurred. The invention in one form provides an inner container which is in turn at least partially covered with a tamper evident packaging material. The packaging material is a tamper evident composite material comprising a photopolymerizable composition layer which is cured and it becomes extremely brittle such that any physical penetration of this packaging material will cause the brittle layer to fracture or shatter. Such shattering will provide a clear indication that penetration of the packaging material has occurred. Also there may be provided an asociated dye which will exhibit a color change when the brittle layer is fractured or shattered. The tamper evident composite material of the present invention is also useful in the form of a non-transferable label or sticker which cannot be removed of re-use in that the brittle laeyr thereof fractures or shatters when the label or sticker is removed or tampered with.

19 Claims, 6 Drawing Sheets

TAMPER EVIDENT PACKAGE

BACKGROUND OF THE INVENTION

1. Field of the Invention

This invention relates to tamperproof packaging and, more specifically, it relates to a tamper evident package and composite material and a method of sealing packages such that a clear indication would be given if any tampering occurs and more specifically the invention relates to a tamper evident composite material useful as an exterior packaging material and as a non-transferable label or sticker which has a layer of material that becomes extremely brittle once cured. A package sealed with this packaging material cannot be unsealed without noticeably shattering the packaging material.

2. Description of the Prior Art

The tampering with and adulteration of many commercially available products has become a critical problem endangering health and sanitation. Many products which are adulterated or tampered with ultimately reach a consumer bearing no indication that such adulteration or tampering has occurred. Accordingly, it is highly desirable to provide a type of packaging material which would give an indication that there has been interference with the integrity of the product packaging.

Various mechanical indications used to determine the integrity of several types of products and containers have been known. For example, U.S. Pat. No. 3,662,915 relates to a tamperproof package which provides a recessed tab in the inner periphery of a container which breaks away from the remainder of the container when entry is made into the container so as to indicate that tampering with the package has occurred.

It has known to employ elastomeric materials disposed in protective surrounding relationship with respect to a container. See U.S. Pat. Nos. 4,546,881, 4,449,632, and 4,181,223.

U.S. Pat. No. 2,074,490 discloses a tamperproof container in the form of a tinplate container having a composite coating consisting of a heat sensitive paint, printing ink, and varnish. This coating is said to distort responsive to any effort to remove the can end, get access to the contents, and then solder the end to the can.

It has been known to provide for rupturing of outer coatings which fracture responsive to operation of a tear strip. See U.S. Pat. No. 3,415,402. See also U.S. Pat. No. 4,479,585.

It has been known to protect printed circuit boards by ultraviolet curable polymeric coatings which are intimately bonded to such boards. See U.S. Pat. Nos. 4,451,523 and 4,424,252.

In addition to such mechanical indicators, it has been known to provide a color indication that package integrity has been interrupted. For example, U.S. Pat. No. 3,935,960 provides a hermetically sealed container having a tape closure over an aperture for removing the contents of the container. The tape closure is provided with an indicator layer of color capsules which rupture when the tape closure is removed.

U.S. Pat. No. 4,502,605 provides an indicator dye/activator system which is mounted on the cap of a container in such a way that opening the cap of the container causes the indicator material to oxidize and thereby change in color. It teaches the use of a volatile alkali solution such as ammonia as an activator having a pH in the range of 9–12 whereas atmospheric and has a pH in the range of 5–7. The preferred indicator dye is sold to be phenolphthalein or other dyes sensitive to changes in the pH. See also U.S. Pat. No. 4,516,679.

U.S. Pat. No. 4,098,577 also discloses use of a pH sensitive dye which will display a different color when in contact with atmospheric air which would occur when the package is opened. U.S. Pat. No. 4,505,399 provides a sheet of material sensitive to light or oxygen which would effect a time-delayed, irreversible change in appearance in response to exposure. The sensitive material would be placed between two inactive sheets and the combination would be placed over the opening to the container so that the sensitive sheet would have to be exposed when the container is opened.

Some of the problems which have been encountered in using the prior art techniques are that they can be circumvented by various means. In addition, the known methods are primarily confined to use with certain types and configurations of containers.

U.S. Pat. No. 4,890,763 discloses the use of an exterior coating which is extremely brittle and which will shatter when any puncture of the coating occurs. Even though it is capable of providing an effective method to indicate that a product has been tampered with or adulterated, the utilization of this coating is extremely difficult. The liquid coating, when applied to an object, is capable of leaking through gaps at the seams of the container or gaps in the closure of the container opening into the container, resulting in contamination of the materials in the container. In addition, the flow of the liquid coating is influenced by gravity, wetting forces and various other factors. Thus the resulting coatings after curing often exhibit irregular shapes with great variations in thickness making the coating very unattractive to the consumers and difficult to package because of the irregularity in size.

In spite of the existing prior art techniques, there remains a need for an effective method of indicating that a product has been tampered with or adulterated. There remains a need for such a method which is economical and easy to use with a wide range of package configurations without risk of contamination.

SUMMARY OF THE INVENTION

The present invention has met the above-described need by providing a packaging material which is a tamper evident composite material provided with a layer of material which becomes extremely brittle once cured and which will then shatter or fracture when any puncture of the packaging material occurs. Also provided is a method of packaging products which involves packaging the container with a packaging material having a layer of extremely brittle material such that the container cannot be unsealed without noticeably and irreversibly shattering or fracturing the packaging material. Alternatively, another embodiment of the present invention would provide a packaging tape for sealing vulnerable portions of the package to be used that would be comprised of a layer of the extremely brittle material.

In a preferred embodiment, the extremely brittle material would be a photopolymerizable composition containing a binder such as an acrylic copolymer, a polymerizable material such as trimethyloylpropane triacrylate and other additives such as flow modifiers, which is supported on a plastic sheet such as polyethylene terephthalate and is used as a tamper evident packaging material or tape. This photopolymerizable composition is then irradiated to cure the reactive ingredients to generate a fracture brittle polymer which adheres tenaciously to the container being packaged. The plastic sheet would act as a backing film which may be removed, if desired. If the container is tampered, the brittle polymer will shatter to leave evidence of tampering. In addition, a pull tab or tear strip may be incorporated into the packaging tape or sheet, respectively, to facilitate at least partial removal of the tamper evident packaging material by the consumer and access to the contents of the package.

It is also contemplated that a moisture or oxygen sensitive dye may be placed between the package and the fracture brittle layer of the packaging material or between the brittle layer and the backing film which would exhibit a distinctive change in coloration if anything has penetrated the brittle layer.

It is also contemplated in one embodiment that fracture of the brittle layer will expose an underlying warning.

It is an object of the invention to provide a package and method which will effectively and economically permit detection of any tampering with or adulteration of the packaging of presently commercially available products.

It is another object of the invention to provide a package and method for protecting against tampering for use with a variety of containers of different shapes, configurations, and materials without being limited to a particular package design.

It is a further object of the present invention to provide a method for easily determining the integrity of the package immediately upon observation of the package.

It is yet another object of the present invention to provide a method of packaging which is easy and economical to apply to the container.

It is a further object of the invention to provide a tamper evident composite material which offers detection of tampering with the package.

It is yet another object of the invention to provide a non-transferable label or sticker which offers detection of tampering therewith or attempted removal thereof.

These and other objects and advantages of the present invention will be more fully understood from the following detailed description of the present invention wherein reference is made to the figures in the accompanying drawings.

DETAILED DESCRIPTION OF THE PREFERRED EMBODIMENT

Figure 1:
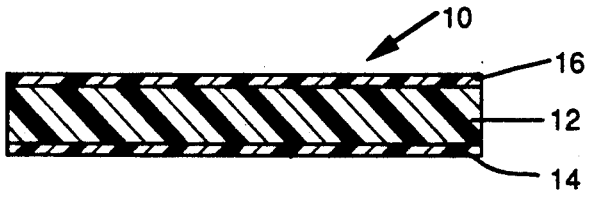
FIG. 1 is a cross-sectional view of one embodiment of the packaging material of the present invention.

Tampering with and/or adulteration of food, drug, and medical products has become increasingly more common and the effects of such activities have become increasingly more dangerous to health and has in some instances have proved fatal. By providing packaging which readily exhibits to the naked eye the fact that a product has been tampered or interfered with, consumers can be put on notice and can avoid purchasing such products.

According to the device and method of the present invention, a package is partially or totally covered with a packaging material having a layer of extremely brittle material and a film backing. The layer of extremely brittle material is preferably a photopolymerizable composition which is malleable and flexible prior to being exposed to actinic radiation, for example ultraviolet light. Prior to being cured, the photopolymerizable composition is preferably tacky to aid in the application of the packaging material to the desired area of the package, such as a container. After being cured, the film backing may optionally be removed leaving the brittle layer of fairly uniform thickness on the package.

In a preferred embodiment, the photopolymerizable composition comprises a polymeric binder, a polymerizable material, and a photoinitiator. Other additives as needed, for example, flow modifiers, polymerization inhibitors, antioxidants, fillers, pigments, dyes and the like may also be present as is well known in the art.

The polymeric binder includes polymers prepared by the addition polymerization of alpha, beta ethylenically unsaturated monomer units and derivatives thereof. A suitable example would be the partially esterified copolymer of styrene-maleic anhydride copolymer. The glass transition temperature of the polymeric binder should be between 30° C. to 200° C., preferably between 90° C. to 160° C. so that the resultant layer of the photopolymerizable composition becomes extremely brittle after curing.

The polymerizable material includes monomers and macromonomers containing a polymerizable site of ethylenic unsaturation. Unsaturated monomers which are suitable for this application are multifunctional acrylates or allylic compounds and derivatives thereof. For example, one can mention trimethylolpropane tri(meth)acrylate, 1,6-hexanediol di(meth)acrylate, 1,3-butylene glycol dimethyacrylate, neopentyl glycol di(meth)acrylate, pentaerythritol tri- and tetra(meth)acrylate, propoxylated or ethyoxylated trimethylolpropane tri(meth)acrylate, allyl methacrylate, diallyl phthlate and the like.

Examples of photoinitiators could be benzophenone, 2-hydroxy-2-methyl-1-phenyl-propan-1-one, benzoin, benzoin ethyl ether, 4,4-dimethoxy-benzoin, 2-methylthioxanthone, and the like.

The polymerizable material also includes cationically polymerizable monomers. Examples of such monomers include cycloaliphatic epoxides and derivatives thereof such as 3,4-epoxycyclohexyl-methyl-3,4-epoxycyclohexane carboxylate and vinyl ether derivatives thereof such as diethyleneglycol divinyl ether. Typical cationic photoinitiators are the onium salt photoinitiators such as triphenylsulfonium hexafluoroantimonate. Other cationically polymerizable monomers and cationic photoinitiators are disclosed in U.S. Pat. No. 4,890,763, which is hereby incorporated by reference.

In order to prepare the photopolymerizable composition, the various ingredients may be simply combined or stirred in a suitable solvent therefor by simple mixing for a suitable period, and then the casting the composition onto the backing film. The backing film may be a plastic film, for example polyethylene terephthalate. The solvent is evaporated. The photopolymerizable composition at this point is a viscous material which does not readily flow and appears to be a solid at room temperature which is malleable and flexible and is, optionally, tacky. As such, the risk of contaminating the contents of the package by the tamper evident packaging material is substantially reduced, if not eliminated. Such a construction is similar to the regular adhesive tapes or sheets. The process should preferably be carried out under "yellow" light conditions to protect the preparation from ultraviolet light until curing is performed.

After the packaging material is applied onto any desired object, the polymerizable composition thereof can then be converted, i.e., cured, into a fracturable brittle layer by additional chemical reactions induced by actinic radiation. The brittle layer thereof is preferably cured, for example, by subjecting the package to a band of radiant ultraviolet light. This may preferably be accomplished by exposing the packaging material thereon to a suitable untraviolet light source, preferably from a medium pressure mercury vapor lamp which is known in the art. Alternatively, other methods of curing the brittle layer may be used. The ultraviolet radiation required is preferably of an intensity of about 175 watts and it would be sufficient to expose the product to this radiation for at least about two seconds per three square feet of material. Other materials may require a shorter period of radiation exposure. When the layer of brittle material is cured with the ultraviolet light in the presence of suitable photoinitiators, the polymerizable materials therein polymerize and crystallize resulting in a hard and fracture brittle material. Accordingly, any tampering with a product packaged with this packaging material will cause the packaging material to shatter and/or fracture. Once cured, the backing film can optionally be removed. As desired, the packaging material may be applied to the entire package exterior or may be applied solely to certain critical areas. One or more overlying layers of the packaging material may be applied if desired.

Prior to applying the packaging material, a separation or release layer of silicon, tetrafluoroethylene ("Teflon"), oily film, cellophane, or a thin nylon membrane, for example, may be applied to the package, if desired, to resist adherence of the layer of brittle material to the underlying portion of the package to be protected.

The layer of the brittle material may be of any desired thickness depending upon the purpose for which it is to be used and the specific formulation, i.e., ingredient make-up, to be used. For most purposes, the thickness would preferably be in the range of from about 0.001 inch to about 0.050 inch and is more preferably from about 0.001 inch to about 0.015 inch.

For those configurations where PSA is also used, the thickness of the PSA layer may be from about 0.0002 inch to about 0.05 inch, preferably from about 0.0003 inch to about 0.0015 inch.

The backing film is preferably chosen from a variety of films composed of high polymers, e.g., polyamides, polyolefins, polyesters, vinyl polymers, and cellulose esters and may have a thickness of from about 0.000125 inch to about 0.02 inch, preferably from about 0.000125 inch to about 0.0087 inch. The backing film should transmit therethrough a sufficient amount of actinic radiation to allow proper curing of the photopolymerizable composition layer to take place.

A particularly suitable backing film is a transparent cellulose acetate film having a thickness of about 0.002 inch. Another example is a transparent polyethylene terephthalate film having a thickness of about 0.001 inch.

Optionally, a thin layer of a material which improves the adhesion of the uncured photopolymerizable composition layer to the backing film may be incorporated therebetween. This adhesion composition layer may be utilized to facilitate the die cutting operation by minimizing or eliminating the occurrence of delamination during the manufacture of labels or stickers from a sheet of packaging material. However, the adhesion composition layer should not substantially decrease the ability of the cured photopolymerizable composition layer to flake off when fractured. An example of a suitable adhesion promoting material would be a pressure sensitive adhesive. The thickness of this layer is selected to allow the cured photopolymerizable composition layer to flake off, preferably from about 0.00005 mil to about 0.003 inch and more preferably from about 0.0001 inch to about 0.001 inch. Other suitable adhesion promotion materials may be printing inks.

Commercial release films which provide adequate release characteristics can be used with the packaging material of the present invention. A particularly suitable release film is a release treated polyethylene terephthalate film having a thickness of about 0.0015 inch.

The present invention also contemplates an optional additional indicator, if desired, which would involve use of a moisture or oxygen sensitive dye as an additional indicator of tampering. Such a dye would preferably be placed between the layer of brittle material and the backing film. A preferred dye would be hydroscopic alkaline. When such a dye is used, no color change would be present if the outer coating or the packaging has not been broken. However, once the packaging is broken, air or oxygen may penetrate into the interior packaging. Once this occurs, a distinctive coloration change would occur and would be immediately and readily visible. It is contemplated that other types of dyes could be used within the bounds of the present invention. This color changing chemical would be an additional safety feature which would give a further indication that the product concerned has been subjected to tampering.

In addition to the aforementioned safety features, it is contemplated that a tear strip would be provided to facilitate proper opening of the package. A pre-formed tear strip which has been treated with the appropriate coating material and properly cured could be placed on the package to function as an opening mechanism and also as an indicator of any tampering as tampering with the tear strip will break the chemical seal and will fracture the brittle layer and other overlying packaging material.

The novel packaging material embodying the present invention may be constructed in a number of ways. Some of these are described below.

Figure 2:
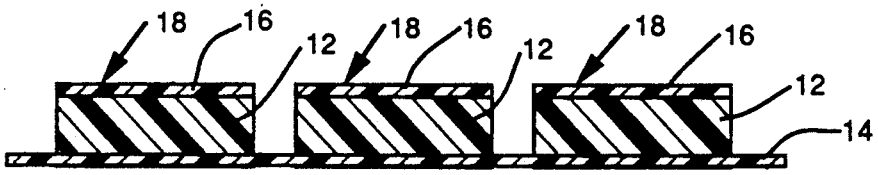
FIG. 2 is a cross-sectional view of another embodiment of the present invention wherein the packaging material shown in FIG. 1 is in the form of individual stickers or strips.

Referring now to the drawings in which like numerals denote similar elements, and more particularly FIGS. 1 and 2, there is shown by way of illustration, but not of limitation, a cross-section of an exterior packaging material 10 comprising a layer 12 of the photopolymerizable composition which is sandwiched between a release film 14 and a backing film 16. As shown in FIG. 2, the backing film 16 and the layer 12 of the photopolymerizable composition may optionally be cut into individual stickers 18.

Figure 3:
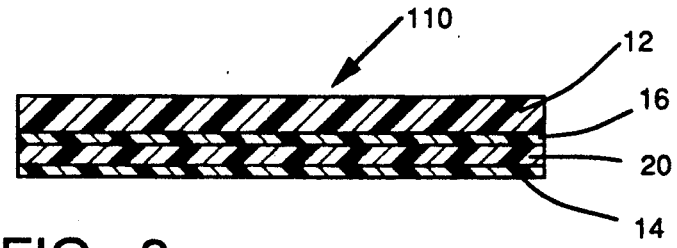
FIG. 3 is a cross-sectional view of another embodiment of the packaging material of the present invention.

Referring to FIG. 3, there is shown a cross-section of another embodiment of an exterior packaging material 110 comprising a layer 20 of a conventional pressure sensitive adhesive (PSA) which is sandwiched between the release film 14 and the backing film 16 and the layer 12 of the photopolymerizable composition on the other surface of the backing film 16. The PSA layer 20, the release film 14 and the backing film 16 may be a conventional PSA tape onto which the photopolymerizable composition has been coated to form the layer 12.

Figure 4:
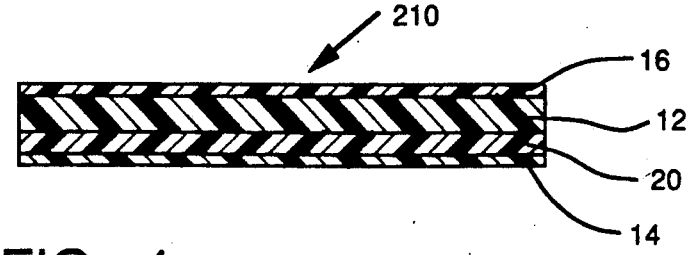
FIG. 4 is a cross-sectional view of another embodiment of the packaging material of the present invention.

Referring to FIG. 4, there is shown a cross-section of another embodiment of an exterior packaging material 210 comprising the layer 12 of the photopolymerizable composition sandwiched between the PSA layer 20 and the backing film 16 and the release film 14 on the other surface of the PSA layer 20. Unlike most conventional pressure sensitive adhesive tape which can be peeled away from the substrate, to our surprise the exterior packaging material 210, after the photopolymerizable composition layer 12 was cured, the peel strength of the PSA was increased to the point that removing the adhesive from the substrate to which the exterior packaging material 210 was applied becomes almost impossible.

Figure 5:
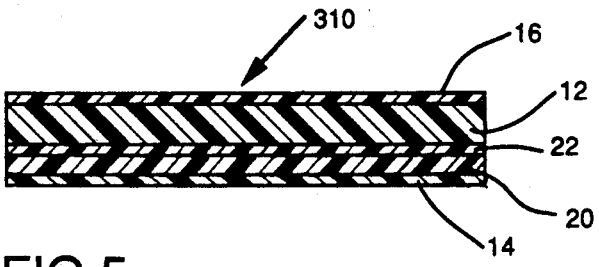
FIG. 5 is another embodiment of the packaging material of the present invention.

Referring to FIG. 5, there is shown a cross-section of another embodiment of an exterior packaging material 310 comprising the photopolymerizable composition layer 12 sandwiched between the backing film 16 and a backing tape 22 and the PSA layer 20 sandwiched between the backing tape 22 and the release film 14. The backing tape 22 may be of a material suitable for use as the backing film 16.

An additional indicator, such as a moisture or oxygen sensitive dye, can optionally be used along with the present invention to provide additional evidence of tampering. Such a dye would preferably be placed between the photopolymerizable composition layer and the backing film. With such a design, the backing film should stay with the package and not be removed after the photopolymerizable composition layer is cured. Once the tamper evident packaging material of the present invention is broken, air or oxygen may penetrate into the space where the dye reside and cause a color change. A preferred dye would be hydroscopic alkaline. Other types of dyes could be used within the bounds of the present invention.

Figure 6:
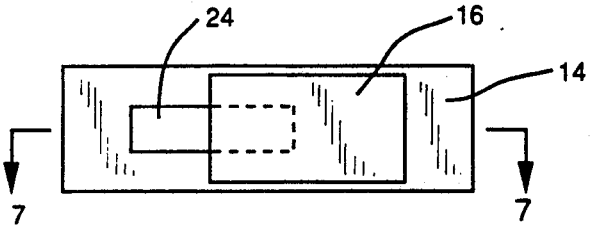
FIG. 6 is a top view of another embodiment of the packaging material of the present invention in the form of a sticker having a tear strip.
Figure 7:
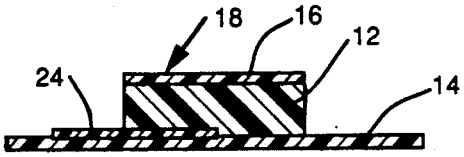
FIG. 7 illustrates a cross-sectional view taken along lines 7—7 of the embodiment shown in FIG. 6.

As shown in FIGS. 6 and 7, a tear strip 24 can also be provided with the sticker 18 of FIG. 2, for example, to facilitate proper opening of the package. The tear strip 24 is preferably placed between the photopolymerizable composition layer 12 and the release film 14 with a portion of the tear strip exposed for the user to pull on when opening the package to which the sticker 18 is applied.

Different combinations of the above configurations can also be prepared.

Figure 11:
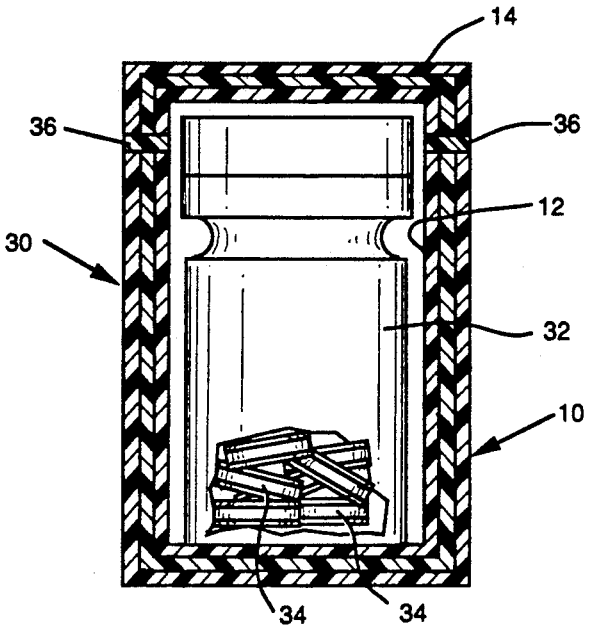
FIG. 11 shows a cross-sectional view of another embodiment of the present invention wherein an outer package which holds an inner container is covered with the packaging material of the present invention.
Figure 12:
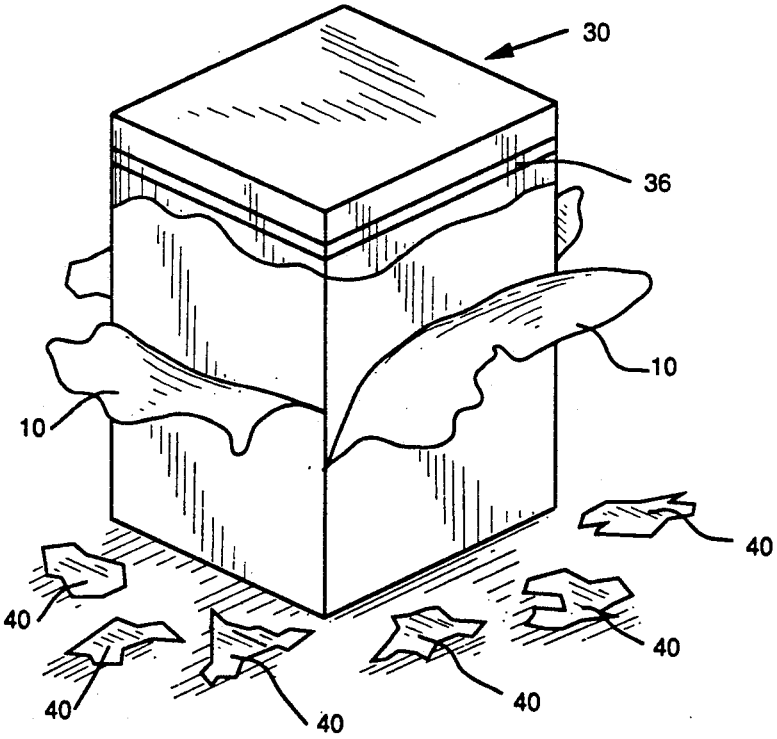
FIG. 12 shows a perspective view of one embodiment of the present invention after the brittle layer of the packaging material of the present invention has been shattered due to tampering or some other interference with the package integrity.

Referring now to FIGS. 11 and 12, another preferred embodiment of the device of the present invention will be discussed. Package 30 holds inner container 32. Here, package 30 is completely covered by the tamper evident packaging material 10 with the release film 14 removed. Inner container 32 holds contents 34 which may be pharmaceutical products such as capsules or tablets, for example. Tear strip 36 is provided to facilitate ease of opening of the package. By simply pulling the tear strip 36, the brittle layer 12 of the packaging material 10 is fractured. It will be appreciated that as the cured packaging material 10 overlies the tear strip 36, the tear strip 36 cannot be operated without fracturing the brittle layer 12. This fracturing without operation of tear strip 36 is illustrated in FIG. 12 where packaging material 10 is fractured by some form of physical penetration. Physical puncturing with a needle, or any attempt to open or interfere with package 30 results in fracture of packaging material 10. As noted above, a dye could also be used in addition to protective layer 12 to further enhance the likelihood that any product with which any tampering has occurred will be avoided.

As is shown in FIG. 12 when the cured brittle layer 12 is shattered at least some portions thereof separate from the portion of the package 30 to which it had been secured. Some of such separated portions 40 may also separate from other portions of layer 40. In either event there is provided a tangible, readily visible indication of tampering.

Figure 13:
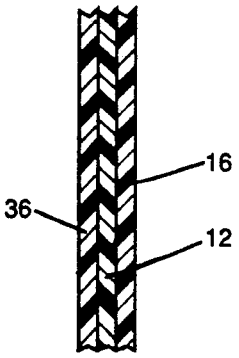
FIG. 13 shows a cross-sectional view of a portion of the side wall of a package according to one embodiment of the present invention.

FIG. 13 shows the sidewall of a package 30 in further detail. Package 30 has wall 36 which has brittle layer 12 and backing film 16 thereon. The indicator dye (not shown) could be placed between wall 36 and brittle layer 12. One embodiment of the present invention may also optionally remove the film backing 14 leaving the brittle layer 12 having a substantially uniform thickness.

Figure 14:
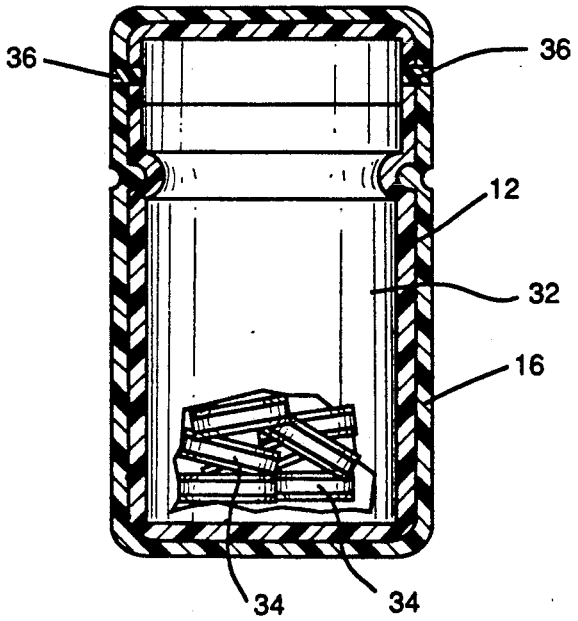
FIG. 14 shows a cross-sectional view of another embodiment of the present invention wherein the inner container of FIG. 11 is covered exteriorly and directly thereto with the packaging material of the present invention.

The package 30 as shown in FIG. 11 is covered with the packaging material 10. However, it is also contemplated and would be within the scope of the present invention that, as shown in FIG. 14 for example, a container, such as inner container 32, may be covered entirely with the packaging material 10 after removing the release film 14 with or without the use of an external container such as container 30.

Figure 15:
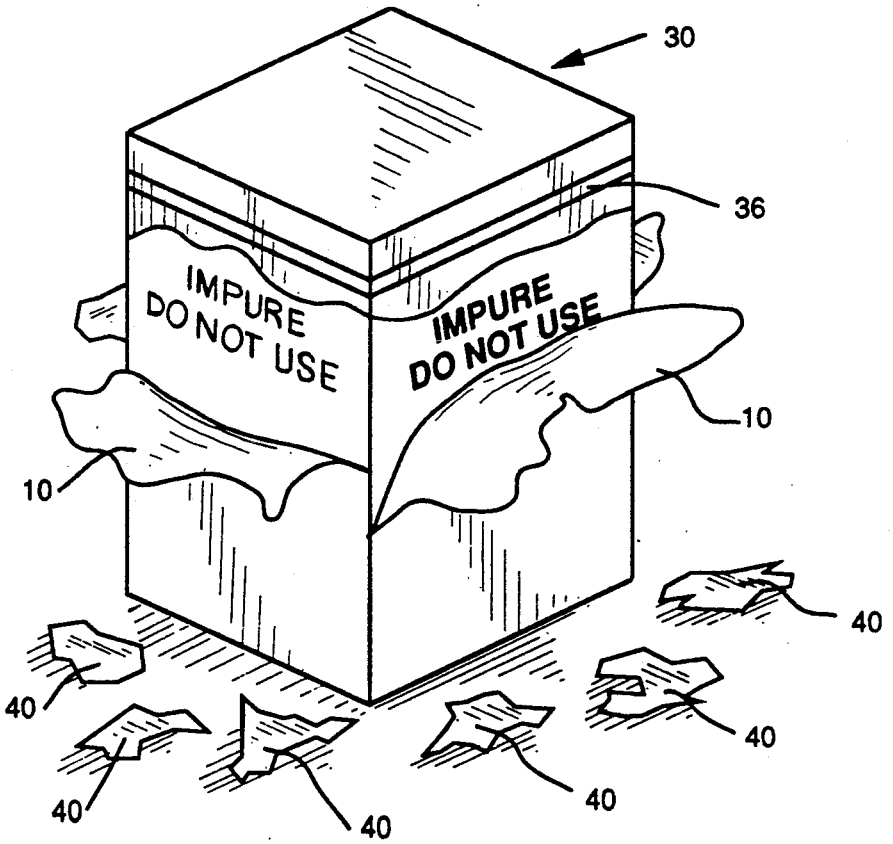
FIG. 15 is identical to FIG. 12, except that it shows an underlying warning message.

If desired, an enhanced visual indication may be provided by providing words or graphics or both as a warning indicator which would be visible only if tampering has occured. For example, the words "IMPURE DO NOT USE" could be provided in a number of locations on the package 30 of FIG. 15 in positions underlying the packaging material 10 such that the packaging material 10 will conceal the message unless tampering has occured. The message may be concealed by providing both the packaging material 10 and the message of generally the same color which color contrasts with the underlying package component on which it appears. Alternatively, in the embodiment shown in FIG. 12, the portions of package 30 underlying tear strip 36 could contain such legends.

Figure 16:
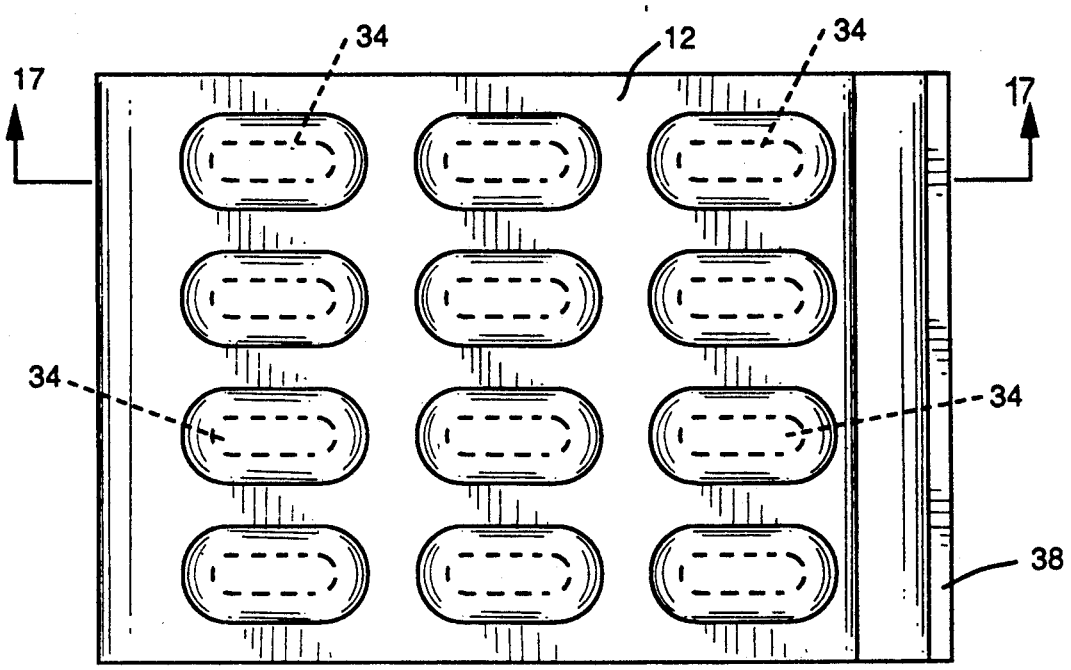
FIG. 16 shows a plan view of a blister package configuration of the present invention.
Figure 17:
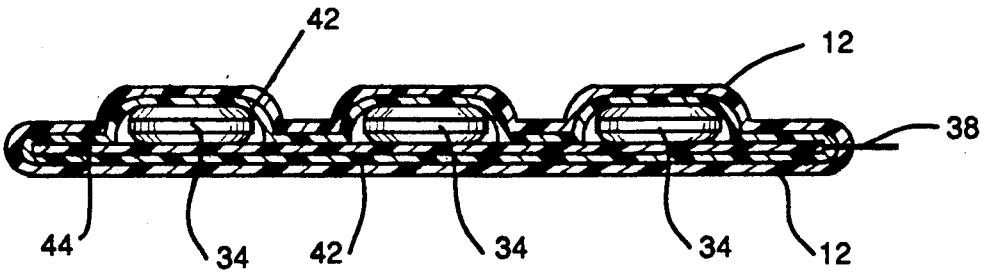
FIG. 17 shows a cross-sectional view of the package of FIG. 16 along lines 17—17.

Alternatively, the packaging material 10 could be used, as shown in FIGS. 16 and 17, for example, with a "blister" packaging commonly used for packaging individual capsules or tablets 34. The blister packaging has first layer 42 and second layer 44. Sandwiched between first layer 42 and second layer 44 are tablets 34. A tear strip 38 may also be provided for ease of opening. This entire assembly is covered exteriorly with the packaging material 10 after removing the release film 14 (not shown) and is then cured according to the present invention. As shown in FIGS. 16 and 17, the backing film 16 (not shown) has also been removed from the packaging material 10 leaving the brittle layer 12 having a substantially uniform thickness. The removal of the backing film 16 is optional. When the tear strip 38 is pulled, brittle layer 12 fractures and/or shatters.

As noted herein, the container to be packaged according to the present invention may contain pharmaceutical products. Alternatively, the packaging material of the present invention could be used for a wide variety of produts wherein package integrity is important. Examples of such other uses are medical instruments and other products which must remain sterile until opened and food products.

In a preferred embodiment of the invention in instances where the brittle material is adjacent to and bonded to a packaging component, the bonding action will be sufficiently small that fracturing of the brittle material by tampering will tend to sever such bonds to facilitate separating of the brittle material from the package material. To the extent to which portions of such material which has separated from the package also separates from adjacent portions of the brittle material pieces, such as pieces 40 in FIG. 12 will fall off.

It will be appreciated that while for convenience of disclosure reference has been made herein to the cured material completely surrounding the product, it will be appreciated that in some instances a cooperating packaging component may be sufficiently impenetrable that the cured material will not be employed in the region of the package where such a packaging component is located.

Figure 8:
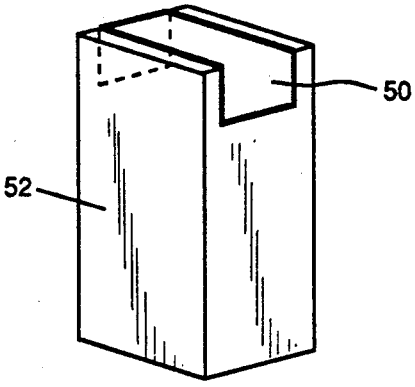
FIG. 8 is a pictorial representation of a cardboard carton with a tamper evident strip placed across the top opening of the carton.
Figure 9:
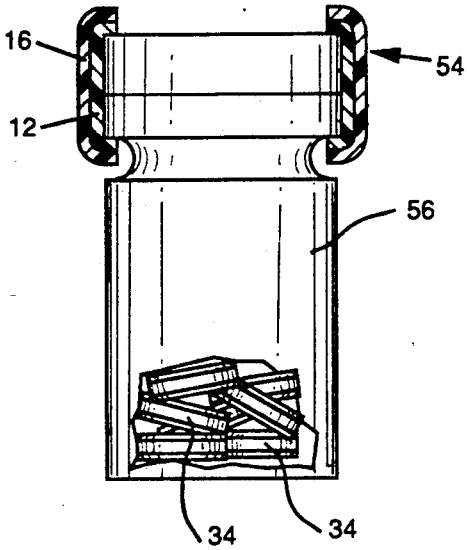
FIG. 9 shows a cross-sectional view of one embodiment of the present invention wherein a strip of the packaging material of the present invention is wrapped around the juncture of the cap of the container and the body thereof.
Figure 10:
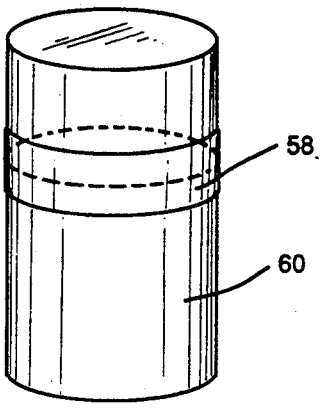
FIG. 10 shows a pictorial representation of a metal can with a strip of the packaging material of the present invention wrapped around the juncture of the removable top of the can and the body thereof.

In some uses, it will be desired to protect solely the portion of the package which is designed to the point of entry or opening during normal usage. Examples of such embodiments are shown in FIGS. 8–10 and in the following Examples.

Figure 18:
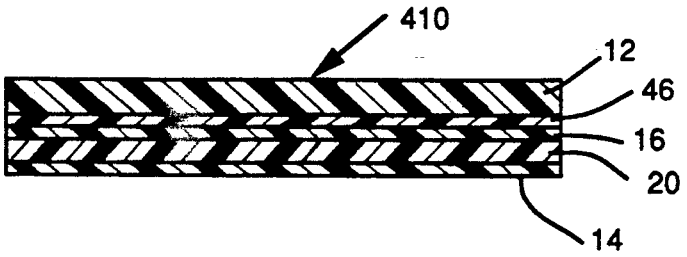
FIG. 18 is a cross-sectional view of an embodiment of a non-transferable sticker of the present invention.
Figure 19:
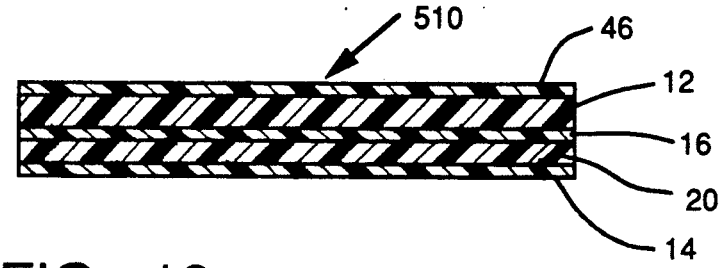
FIG. 19 is a cross-sectional view of another embodiment of an non-transferable sticker of the present invention.

The embodiments of the present invention illustrated in FIGS. 3, 4 and 5 when cut into individual stickers or labels provide additional applications for the tamper evident composite material as non-transferable stickers or labels, such as automobile inspection stickers, automobile license plate renewal decals, parking permits, and danger labels. For example, referring to FIG. 18, there is shown one embodiment of a non-transferable sticker 410 which is a modification of the exterior packaging material 110 shown in FIG. 3. Specifically, an ink layer 46 in the form of a logo, pattern or message is sandwiched between the photopolymerizable composition layer 12 and the backing film 16. Alternatively, referring to FIG. 19, there is shown another embodiment of a non-transferable sticker 510 which is also a modification of the exterior packaging material 110 shown in FIG. 3. Specifically, the ink layer 46 is on the photopolymerizable composition layer 12 opposite the backing film 16.

Figure 20:
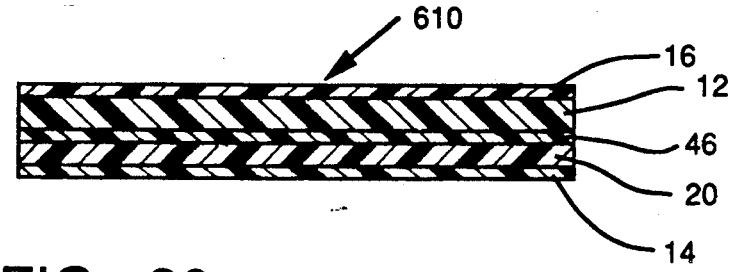
FIG. 20 is a cross-sectional view of another embodiment of a non-transferable of the present invention.

Referring to FIG. 20, there is shown another embodiment of a non-transferable sticker 610 which is a modification of the exterior packaging material 210 shown in FIG. 4. Specifically, the ink layer 46 is sandwiched between the photopolymerizable composition layer 12 and the PSA layer 20.

After the application of the non-transferable sticker to the desired location and the curing of the photopolymerizable composition layer 12 rendering it brittle, the sticker cannot be removed for re-use without the brittle layer 12 flaking off upon tampering with the sticker. In addition, it is preferable to use an ink for the ink layer 46 which adheres strongly to layer 12 so that when portions of the brittle layer 12 fall off the sticker, portions of the ink layer 46 are also removed, providing further evidence of tampering.

EXAMPLES

In order to provide additional insight into the present invention, the following examples and comparative examples will be considered:

EXAMPLE 1

A photopolymerizable composition was prepared by dissolving about 60 parts of trimethoxyloyl propane triacrylate, about 40 parts of a partially esterified styrene-maleic anhydride copolymer (Scripset 550—from Monsanto Chemical, St. Louis, Mo.) and about 2 parts of a photoinitiator, Darocur 1173 (described as 2-hydroxy-2-methyl-1-phenylpropan-1-one, available from EM Chemical, Hawthorne, N.Y.), in about 120 parts of methoxy propyl acetate. The solution was cast on a sheet of about 0.001 inch thick polyethylene terephthalate transparent film (backing film) to give a dry coated thickness of the photopolymerizable composition layer of about 0.004 inch. Referring to FIG. 8, after drying, a strip 50 of the packaging material approximately 1 inch wide and 2 inches long was wrapped around the opening of a cardboard carton 52 for tubes of medical ointments. The photopolymerizable composition layer was then cured, one side at a time, at 10 fpm using an ultraviolet curing unit containing two 200 watts per inch medium pressure mercury lamps. The cardboard carton 52 was sealed by the hardened layer. The polyester backing film may optionally be removed at this point. All attempts to open the carton 52, including cutting the strip 50 with a sharp instrument, caused the strip 50 to shatter thus providing evidence of tampering.

EXAMPLE 2

A photopolymerizable composition was prepared by dissolving about 13.1 parts of trimethylol propane triacrylate, about 13.1 parts of propoxylated trimethylol propane, about 2.6 parts of chlorinated polyester acrylate (Ebecryl 586-from Radcure Company, Norfolk, Va.), about 1.1 parts Darocur 1173, about 26.3 parts of partially esterified styrene-maleic anhydride copolymer (Scripset 550) in about 35 parts of methoxy propyl acetate and about 8.8 parts of methyl ethyl ketone. The solution was cast on a sheet of about 0.001 inch thick polyethylene terephthalate transparent film (backing film 16) to give a dry coated thickness of about 0.005 inch. Referring to FIG. 9, a strip 54 of the packaging material approximately 0.5 inch wide and 1.0 inch long was wrapped around a container 56 containing pharmaceutical tablets 34. The container 56 was warmed to about 45° C. and pressure was applied to improve the adhesion of the photopolymerizable composition layer 12 to the container. The layer 12 was cured, one side at a time, at 10 fpm using an ultraviolet curing unit containing two 200 watts per inch medium pressure mercury lamps. The polyester backing film 16 may optionally be removed at this time. Again all attempts to open the container 56 caused the strip 54 to shatter, thus providing evidence of tampering.

Compared to a commercial package using a conventional pressure sensitive adhesive material as the tamper resistant tape, its tape can be cut easily with a sharp instrument without noticeable evidence that the tape has been tampered with.

EXAMPLE 3

A regular pressure sensitive adhesive (PSA), for example, Aroset 1085-Z-45 (an acrylic polymer-based PSA in a solvent; available from Ashland Chemical, Columbus, Ohio) was cast over the photopolymerizable composition layer 12 described in Example 2. The dry coated thickness of the PSA layer was about 0.0007 inch. Referring to FIG. 10, a strip 58 of this packaging material approximately 0.5 inch wide and 1.0 inch long was wrapped around a metal container 60 about the juncture of the top and bottom of the metal container 60. Pressure was applied to assure good adhesion of the PSA layer of strip 58 to the container 60. The photopolymerizable composition layer was cured under identical conditions as Example 2. Again, the polyester film backing may optionally be removed. Any attempt to open the container 60 caused the strip 58 to shatter into multiple pieces.

COMPARATIVE EXAMPLE 1

A sample coating containing about 20 parts of trimethyloyl propane triacrylate, about 60 parts of diethylene glycol diacrylate, about 118 parts of diacrylate derived from acrylic acid and bisphenol A diepoxides, about 2 parts of photoinitiator Darocur 1173 was applied by brush around the opening of a small metal container. The coating was then cured on both sides at 30 fpm using two 200 watts per inch medium pressure mercury lamps. After opening the container, it became evident that the liquid coating had leaked through the gap of the opening into the container creating the possibility that the liquid coating could contaminate the material inside the container.

EXAMPLE 4

A conventional, commercially available tamper resistant sticker, which is made of a cellulose acetate cover film with a pressure sensitive adhesive layer thereon, is supported on a polyethylene terephthalate release film. A photopolymerizable composition was prepared by dissolving about 67 parts of styrene-allyl alcohol copolymer (RJ100-from Monsanto, St. Louis, Mo.), about 33 parts of a cycloaliphatic epoxide (Cyracure 6100-from Union Carbide, Danbury, Conn.), and 1 part of a suitable photoinitiator (Cyracure UVI-6974; described as triphenyl sulfonium hexafluroantimonate, available from Union Carbide, Danbury, Conn.) in 100 parts of methoxy propyl acetate. The mixture was applied over the sticker to a dried thickness of about 0.003 inch. The coated sticker was removed from the release film and wrapped around the opening of a small metal container, such as shown in FIG. 10. The photopolymerizable composition layer was cured at 10 fpm using a ultraviolet light curing unit containing two 200 watts per inch lamps. After curing, the layer changed into a brittle material. Attempts to remove the sticker or to cut the sticker to open the container caused the brittle layer to shatter extensively thus providing evidence of tampering.

EXAMPLE 5

A photopolymerizable composition was prepared by dissolving about 12 parts of dipentaerythritol monohydroxypentaacrylate, about 12 parts of propoxylated trimethylol propane triacrylate, about 2.4 parts of polyester diacrylate (Ebecryl 586 from Radcure Company), about 24.3 parts of partially esterified styrene-maleic anhydride copolymer (Scripset 540 from Monsanto), about 16 parts of carboxylated epoxy acrylate (Echo 308 from Echo Resins, Versailles, Mo.), about 2 parts of Darocure 1173 and about 0.05 parts of Savinyl Blue RLS (Sandoz Chemicals, Charlotte, N.C.) in about 28 parts of methoxy propyl acetate and about 10 parts of methyl ethyl ketone. The solution was casted onto a sheet of cellulose acetate film to give a dry coated thickness of the photopolymerizable composition layer of about 0.006 inch. To the other side of the acetate film was casted a regular pressure sensitive adhesive, such as Aroset 1085-2-45 (Ashland Chemical) to which a trace amount of a yellow dye was added (Oil Yellow from Keystone Standard Color, Chicago, Ill.). The composite material with the blue coating on the top and the yellow adhesive coating on the bottom of the acetate tape now appears green in color.

A strip of approximately 0.75 inch wide and 1.2 inches long was wrapped around the opening of a cardboard carton with the pressure sensitive adhesive side in contact with the carton. The strip was cured, one side at a time, at 10 fpm using the same curing unit as in Example 1. Any attempt to open the container caused the blue coating to shatter. In addition, the green color changes to yellow in those areas where the blue coating fell off, thus providing more evidence of tampering.

EXAMPLE 6

An arbitrary pattern such as two letters T and S was indented on the blue coating of the composite sticker described in Example 5. The sticker is applied and cured to a cardboard carton as described in Example 5. Upon opening of the carton, the coating shattered; it also broke the indented pattern making it even more obvious that the carton has been opened.

EXAMPLE 7

The blue coating solution described in Example 5 was casted onto a sheet of cellulose acetate film to a dried thickness of about 0.005 inch. To the other side of the acetate film, a solution containing the following composition was coated to give a dried thickness of about 0.001 inch: about 20 parts methyl ethyl ketone, about 20 parts 1-methoxy-2-propyl acetate, about 16 parts Scripset 540; about 29 parts trimethylolpropane triacrylate, about 2.5 parts Darocure 1173. A strip of approximately 0.75 inch wide and 1.2 inches long was wrapped around the opening of a cardboard carton, as in FIG. 8, with the colorless tacky coating in contact with the carton. The strip was cured at the same conditions as Example 5. Any attempt to open the carton caused the coatings on both sides of the acetate tape to break, providing evidence of tampering.

It will further be appreciated, therefore, that the present invention provides a package and associated method for packaging products which provides an irreversible, ready indication that the package has been subjected to tampering or interference.

Whereas particular embodiments of the invention have been described above for purposes of illustration, it will be appreciated by those skilled in the art that numerous variations of the details may be made without departing from the invention as described in the appended claims.

What is claimed is:

1. A tamper evident package comprising:

a container, and an exterior packaging material at least partially covering said container disposed adjacent to the exterior of said container, said exterior packaging material comprising:

a photopolymerizable composition layer on a backing film, said photopolymerizable composition having been cured and become brittle resulting in a brittle layer, whereby any physical penetration of said brittle layer will cause a readily visible, irreversible change in said brittle layer causing separation of at least portions of said exterior packaging material from said container.

2. The package of claim 1, further comprising an indicator substance disposed between said container and said exterior packaging material, whereby upon any physical penetration of said exterior packaging material, said indicator substance undergoes a readily visible irreversible change in coloration.

3. The package of claim 1, wherein said photopolymerizable composition layer is comprised of:

a polymeric binder, a polymerizable material, and a polymerization initiator activated by ultraviolet radiation.

4. The package of claim 3, wherein said photopolymerizable composition layer is about 0.001 inch to about 0.05 inch in thickness.

5. The package of claim 1, wherein said exterior packaging material covers the entire exterior of said container.

6. The package of claim 1, wherein said container contains pharmaceutical products.

7. The package of claim 1, wherein said container contains medical instruments.

8. The package of claim 1, wherein said container contains food products.

9. The package of claim 1, wherein said exterior packaging material includes a tear strip around the outer circumference of said container, whereby pulling said tear strip will cause said brittle layer to shatter.

10. The package of claim 1, wherein said inner container is comprised of a blister package having a first layer and a second layer, said first and second layers having a plurality of capsules for retaining individual pharmaceutical products disposed therebetween.

11. The package of claim 1, further comprising warning message means disposed on said inner container underlying said exterior packaging material.

12. The package of claim 11, wherein said warning message means become readily visible upon removal of overlying portions of said brittle layer.

13. The package of claim 1, wherein said brittle layer is characterized by separation into a plurality of pieces responsive to said physical separation from said container.

14. The package of claim 1, wherein said exterior packaging material further comprises a layer of a pressure sensitive adhesive on said photopolymerizable composition layer opposite said backing film.

15. The package of claim 1, wherein said exterior packaging material further comprises a layer of a pressure sensitive adhesive on said backing film opposite said photopolymerizable composition layer, said layer of a pressure sensitive adhesive disposed adjacent to said container.

16. The package of claim 15, wherein said polymerizable composition layer contains a first color dye, wherein when said brittle layer is fractured and flakes off, the absence of the color of said first color dye become apparent providing further evidence of tampering.

17. The package of claim 16, wherein said pressure sensitive adhesive layer contains a second color dye, said second color dye being a different color from said first color dye, wherein when said polymerizable composition layer and said pressure sensitive adhesive layer are superimposed a third color is apparent and when said brittle layer is fractured and flakes off, the color of said second color dye becomes apparent providing further evidence of tampering.

18. The package of claim 1, wherein said exterior packaging material further comprises a backing tape on said photopolymerizable composition layer opposite said backing film and a layer of a pressure sensitive adhesive on said backing tape opposite said photopolymerizable composition layer.

19. The package of claim 1, wherein said exterior packaging material further comprises an adhesion promoting layer between said photopolymerizable composition layer and said backing film, said adhesion promoting layer characterized by promoting adhesion of said photopolymerizable composition layer to said backing film and by permitting said brittle layer to flake off said container when said brittle layer is fractured.

* * * * *